US009619974B2

(12) United States Patent
Lee

(10) Patent No.: US 9,619,974 B2
(45) Date of Patent: Apr. 11, 2017

(54) GAME OUTCOME GENERATOR FOR A GAMING MACHINE

(71) Applicant: AGS, LLC, Las Vegas, NV (US)

(72) Inventor: Arthur Lee, Las Vegas, NV (US)

(73) Assignee: AGS, LLC, Las Vegas, NV (US)

( * ) Notice: Subject to any disclaimer, the term of this patent is extended or adjusted under 35 U.S.C. 154(b) by 240 days.

(21) Appl. No.: 14/618,431

(22) Filed: Feb. 10, 2015

(65) Prior Publication Data

US 2016/0232754 A1 Aug. 11, 2016

(51) Int. Cl.
*G07F 17/34* (2006.01)
*G07F 17/32* (2006.01)

(52) U.S. Cl.
CPC ..... *G07F 17/34* (2013.01); *G07F 17/3213* (2013.01)

(58) Field of Classification Search
CPC ..... G07F 17/34; G07F 17/3213
See application file for complete search history.

(56) References Cited

U.S. PATENT DOCUMENTS 4,448,419 A * 5/1984 Telnaes ..... G07F 17/3244 273/143 R
5,456,465 A * 10/1995 Durham ..... G07F 17/34 273/143 R
5,511,784 A 4/1996 Furry et al.
5,988,638 A 11/1999 Rodesch et al.
6,003,867 A 12/1999 Rodesch et al.
6,099,408 A * 8/2000 Schneier ..... A63F 13/12 463/16
6,159,096 A 12/2000 Yoseloff
6,193,607 B1 * 2/2001 Kay ..... G06F 7/58 463/22
6,347,795 B1 * 2/2002 De Leljer ..... G07F 17/3244 273/143 R
2004/0209663 A1 * 10/2004 Webb ..... G07F 17/32 463/16
2007/0135214 A1 * 6/2007 Walker ..... G07F 17/32 463/29
2008/0270503 A1 * 10/2008 Nilsson ..... G06F 7/588 708/255
2012/0238341 A1 * 9/2012 Tarantino ..... G07F 17/3248 463/16

* cited by examiner

*Primary Examiner* — Corbett B Coburn
(74) *Attorney, Agent, or Firm* — Weidle & Miller, Ltd.

(57) ABSTRACT

A game outcome generator for a gaming machine is configured with first and second outcome generators. One of the two outcome generators is selected to generate a game outcome for each game. The first outcome generator selects a game result and then selects or generates game data which corresponds to the selected result, such as by selecting a result and associated game data from one or more templates of results and associated game data. The second outcome generator selects game data and then determines the result which corresponds to the selected game data. The game data may comprise slot symbols or reel stops and the results may comprise losing outcomes having no award or winning outcomes having awards of one or more credits.

16 Claims, 3 Drawing Sheets

GAME OUTCOME GENERATOR FOR A GAMING MACHINE

FIELD OF THE INVENTION

The present invention relates to gaming machines and methods of presenting games.

BACKGROUND OF THE INVENTION

Slot type games and gaming machines are well known. Early slot machines were mechanically operated. These machines included a plurality of physical reels which had symbols printed on them. The reels were mechanically rotated and the outcome of the game was determined by the symbols which were displayed when the reels came to a stop.

Later, electronically operated slot machines were developed. A first type of electronically operated slot machine still utilizes physical reels. However, the reels are rotated by motors and those reels are stopped at positions corresponding to a determined outcome. A second type of electronically operated slot machine displays representations of spinning reels graphically on a video display. In both cases, a game outcome is selected and then the reels (physical or video-represented) are stopped at a position which displays that outcome.

A number of methods have been devised for selecting the outcome of a slot type game and then controlling the reels or generating graphics to display the selected outcome. However, existing methods have been determined to have practical or technological drawbacks. These drawbacks include high game volatility (such as where winning outcomes may be separated by long stretches of losing outcomes) or the requirement of significant processing and data storage/memory (thus increasing the game development or presentation time and a higher gaming machine cost).

A new and improved method of generating game outcomes is desired.

SUMMARY OF THE INVENTION

Embodiments of the invention comprise a game outcome generator and gaming machines and systems having or utilizing a game outcome generator.

In one embodiment of the invention, a game outcome generation unit or element comprises or implements at least two outcome generators for generating game outcomes for a game. The game outcome generation unit comprises a selector which is configured to select one of the two game outcome generators to generate a game outcome for each game. In one embodiment, the game is a wagering game wherein the outcome includes a set of game data, such as one or more displayed symbols, and a result, such as a losing result having no award or a winning result having an associated award.

A first game outcome generator is configured to select a game result and then select or determine game data which corresponds to the selected result, such as using one or more templates of results and associated game data. A second game outcome generator is configured to select or generate game data and then determines the result which corresponds to the selected or generated game data.

In the case of a slot type-game, the selected or generated game data may comprise one or more game symbols (or corresponding reel stops or positions) and the result may comprise a winning or losing result, including an award, such as an award of one or more monetary value credits.

In a preferred embodiment of the invention, the first outcome generator may include one or more tables of results, such as a table of awards (wherein no award corresponds to a losing result and an award corresponds to a winning result). Game data corresponding to the awards may be associated with the table of awards or other tables. Preferably, the first outcome generator is only capable of generating or selecting some portion of all possible game outcomes for the game, such as by limiting the possible results or game data, thus limiting the size of the data or processing which is necessary to implement the first game outcome generator.

On the other hand, the second outcome generator is configured to generate all possible outcomes of the game, such as by randomly selecting game data which is capable of representing all potential outcomes of the game.

In one embodiment, the selector of the game outcome generation unit is configured to select the first outcome generator more frequently than the second outcome generator. Because the second outcome generator is selected at one or more times, all potential game outcomes can be generated and presented to the player. However, because the selector is configured to select the first outcome generator more often, characteristics of the game such as one or more of payout percentage, house hold, volatility or other aspects of the game may be more closely controlled.

Further objects, features, and advantages of the present invention over the prior art will become apparent from the detailed description of the drawings which follows, when considered with the attached figures.

DETAILED DESCRIPTION OF THE INVENTION

In the following description, numerous specific details are set forth in order to provide a more thorough description of the present invention. It will be apparent, however, to one skilled in the art, that the present invention may be practiced without these specific details. In other instances, well-known features have not been described in detail so as not to obscure the invention.

Embodiments of the invention comprise a game outcome generator and methods of generating game outcomes and presenting corresponding games having those outcomes. In one embodiment, a game generator of the present invention is utilized to present games at a gaming machine or device 22. Such a gaming machine 22 may have various configurations.

The gaming machine 22 may be located at a casino (and as such may be referred to as a "casino gaming machine"). As described below, the gaming machine 22 may be part of a gaming system, such as a casino gaming system which links two or more of the gaming machines or one or more gaming machines with other devices, such as one or more table games, kiosks, accounting systems or servers, progressive systems or servers, player tracking systems or servers or the like.

Figure 1:
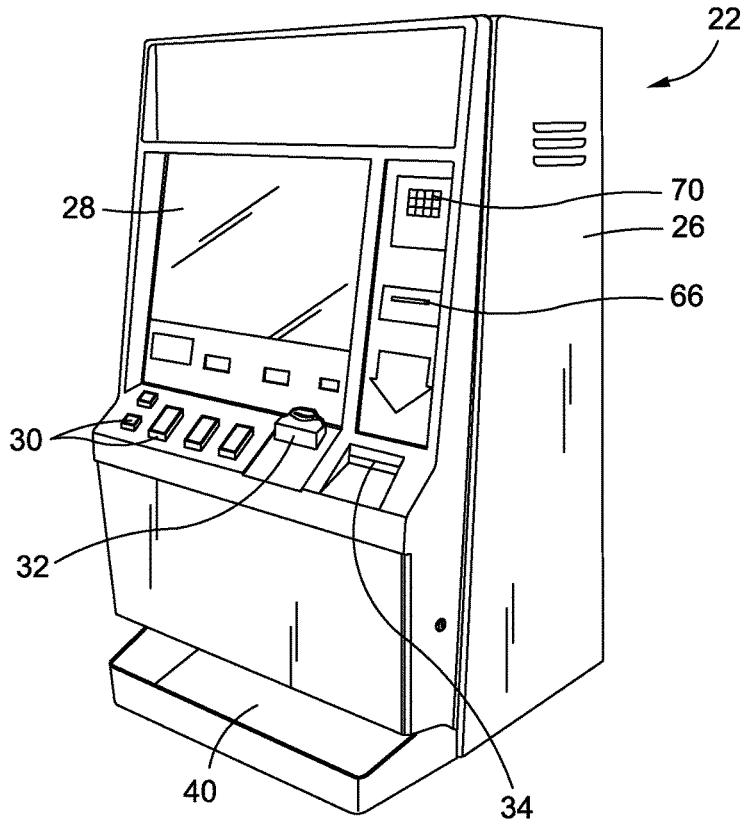
FIG. 1 illustrates a gaming machine comprising one environment of the present invention.

One configuration of a gaming machine 22 is illustrated in FIG. 1. As illustrated, the gaming machine 22 generally comprises a housing or cabinet 26 for supporting and/or enclosing various components required for operation of the gaming machine. In the embodiment illustrated, the housing 26 includes a door located at a front thereof, the door capable of being moved between an open position which allows access to the interior, and a closed position in which access to the interior is generally prevented. The configuration of the gaming machine 22 may vary. In the embodiment illustrated, the gaming machine 22 has an "upright" configuration. However, the gaming machine 22 could have other configurations, shapes or dimensions (such as being of a "slant"-type, "bar-top" or other configuration as is well known to those of skill in the art).

The gaming machine 22 preferably includes at least one display device 28 configured to display game information. The display device 28 may comprise an electronic video display such as a cathode ray tube (CRT), high resolution flat panel liquid crystal display (LCD), projection LCD, plasma display, field emission display, digital micro-mirror display (DMD), digital light processing display (DLP), LCD touch-screen, a light emitting display (LED) or other suitable displays now known or later developed, in a variety of resolutions, sizes and formats (e.g. 4:3, widescreen or the like). The display 28 may be capable of projecting or displaying a wide variety of information, including images, symbols and other indicia or information associated with game play, game promotion or other events. The gaming machine 22 might include more than one display device 28, such as two or more displays 28 which are associated with the housing 26. The gaming machine 22 might also include a top box or other portion. Such a top box might include one or more display devices 28, such as in addition to one or more main displays which are associated with the housing 26. Also, the gaming machine 22 might include side displays (such as mounted to the exterior of the housing 26) and might include multiple displays of differing sizes.

While the display devices may comprise one or more video displays, in another embodiment, the gaming machine 22 may include one or more physical reels capable of displaying game information, such as slot symbols. In such a configuration, means are provided for rotating the physical reels. In one or more embodiments, the means may comprise a mechanical linkage associated with a spin arm, with movement of the spin arm (a "pull") by a user causing the reels to spin. In such an arrangement, the reels are generally allowed to free-wheel and then stop. In another embodiment, electronically controlled mechanisms are arranged to rotate and stop each reel. Such mechanisms are well known to those of skill in the art. In this arrangement, actuation of the spin arm or depression a spin button causes a controller (not shown) to signal the activation of the spin mechanism associated with one or more of the reels. Preferably, the controller is arranged to either turn off the signal to the device(s) effecting the rotation of each or all of the reels or generates a signal for activating a braking device, whereby the reels are stopped. The principal of such an arrangement is described in U.S. Pat. No. 4,448,419 to Telnaes, which is incorporated herein by reference.

As described in more detail below, the gaming machine 22 is preferably configured to present one or more games upon a player making a monetary payment or wager. In this regard, as described in more detail below, the gaming machine 22 includes means for accepting monetary value.

The one or more games which are presentable by the gaming machine 22 each preferably have more than one potential outcome. Preferably, at least one game outcome is designed as a losing outcome and at least one game outcome is designated as a winning outcome. Losing outcomes may result in no associated award and, in the case where the game is wager-based, loss of some or all of the player's wager. On the other hand, prizes or awards may be provided for winning outcomes, such as monetary payments (or representations thereof, such as prize of credits), or promotional awards as detailed herein. As detailed below, the gaming machine 22 includes means for returning unused monetary funds and/or dispensing winnings to a player.

The gaming machine 22 preferably includes one or more player input devices 30 (such as input buttons, plunger mechanisms, a touch-screen display, joystick, touch-pad or the like). These one or more devices 30 may be utilized by the player to facilitate game play, such as by providing input or instruction to the gaming machine 22. For example, such input devices 30 may be utilized by a player to place a wager, cause the gaming machine 22 to initiate a game, to indicate cards to be held or discarded, to "cash out" of the gaming machine, or to provide various other inputs.

In one preferred embodiment, the gaming machine 22 includes at least one microprocessor or controller for controlling the gaming machine, including receiving player input and sending output signals for controlling the various components of the machine 22 (such as generating game information for display by the display 28). The gaming machine controller may be arranged to receive information regarding funds provided by a player to the gaming machine, receive input such as a purchase/bet signal when a purchase/bet button is depressed, and receive other inputs from a player. The controller may be arranged to generate information regarding a game, such as generating game information for display by the at least one display 28 (such as information representing images of displayed cards), for determining winning or losing game outcomes and for displaying information regarding awards for winning game outcomes, among other things.

The controller may be configured to execute machine readable code or "software" or otherwise process information, such as obtained from a remote server. Software or other instructions may be stored on a memory or data storage device.

As disclosed below, the gaming machine 22 may include or implement a game outcome generator or may receive game outcome information from a remotely located game outcome generator.

Preferably, the controller is configured to execute machine readable code or instructions which are configured to implement the method of game play of the invention. For example, the controller of the gaming machine 22 may be configured to detect a wager, such as a signal from a player's depressing of the "bet one" button. Upon such an event and/or the player otherwise signaling the gaming machine to present the game, the controller may be configured to cause game information to be displayed on the at least one display 28. As discussed below, this information may comprise images of reels or slot symbols, for example. The controller may accept input from a player of game play inputs via the one or more player input devices of the gaming machine 22.

The gaming machine 22 may be configured to generate and present games in a stand-alone manner or it may be in communication with one or more external devices at one or more times. For example, the gaming machine 22 may be configured as a server based device and obtain game data, code or game outcome information from a remote device, such as a remote game server (in which event the gaming machine controller may receive game information from the server, such as game outcome information, and use that server-generated information to present the game at the gaming machine).

As indicated, in a preferred embodiment the gaming machine 22 is configured to present one or more wagering games. Thus, the gaming machines 22 is preferably configured to accept value, such as in the form of coins, tokens, paper currency or other elements or devices representing value such as monetary funds. For example, as illustrated in FIG. 1, the gaming machine 22 might include a coin acceptor 32 for accepting coins. Of course, associated coin reading/verifying devices and coin storage devices may be associated with the gaming machine 22 if it is configured to accept coins. Likewise, the gaming machine 22 might include a media reader 34. Such a reader may be configured to accept and read/verify paper currency and/or other media such as tickets. Of course, in such event the gaming machine 22 may further be configured with one or more paper currency or ticket storage devices, such as cash boxes, and other paper currency or media handling devices (including transport devices).

The gaming machine 22 might also be configured to read FOBs, magnetic stripe cards or other media having data associated therewith and via which value or funds may be associated with the gaming machine 22.

In one embodiment, the gaming machine 22 is configured to award winnings for one or more winning wagering game outcomes. Such winnings may be represented as credits, points or the like. In one embodiment, the player may "cash out" and thus remove previously associated funds and any awarded winnings or such may otherwise be paid to the player. For example, upon an award or at cash-out, associated funds may be paid to the player by the gaming machine 22 dispensing coins to a coin tray. In another embodiment, funds may be issued by dispensing paper currency. In yet another embodiment, a player may be issued a media, such as a printed ticket, which ticket represents the value which was paid or cashed out of the machine. The aspects of gaming machine "ticketing" systems are well known. One such system is described in U.S. Pat. No. 6,048,269 to Burns, which is incorporated herein in its entirety by reference.

The gaming machine 22 may also include a player tracking device, such as a card reader 66 and associated keypad 70. Such player tracking devices are well known and may permit the game operator to track play of players of the gaming machine. The tracked play may be utilized to offer player bonuses or awards.

It will be appreciated that the gaming machine illustrated in FIG. 1 is only exemplary of one embodiment of a gaming machine. For example, it is possible to for the gaming machine to have various other configurations, including different shapes and styles and having different components than as just described.

For example, it is possible for the game of the invention to be presented on a computing device, including at a home or office computer or a player's mobile electronic device such as a PDA, phone or the like. In one embodiment, a player might log in to a casino server and the controller of the casino server may cause game information to be delivered to the player's computer via a communication link and then be displayed on a display of the player's computer. The communication link might comprise or include the Internet, a casino network such as a wired or wireless LAN, or combinations of public and/or private networks including wired and/or wireless links. In such a configuration it will be noted that the term "controller" may comprise more than one device. For example, in a server-based environment, a controller at a server may generate game information and transmit that information to a local controller at a gaming machine or a player's computer or other electronic device. The local controller at the gaming machine or the player's computer or other electronic device may then cause game information to be displayed on one or more associated displays. The games of the invention could also be presented by or at hand-held devices, such as PDAs, cellular phones, tablet computing devices or the like.

A casino may have numerous such gaming machines 22, such as located on a casino floor or in other locations. Of course, such gaming machines 22 might be used in other environments, such as an airport, a bar or tavern or other locations.

Figure 2:
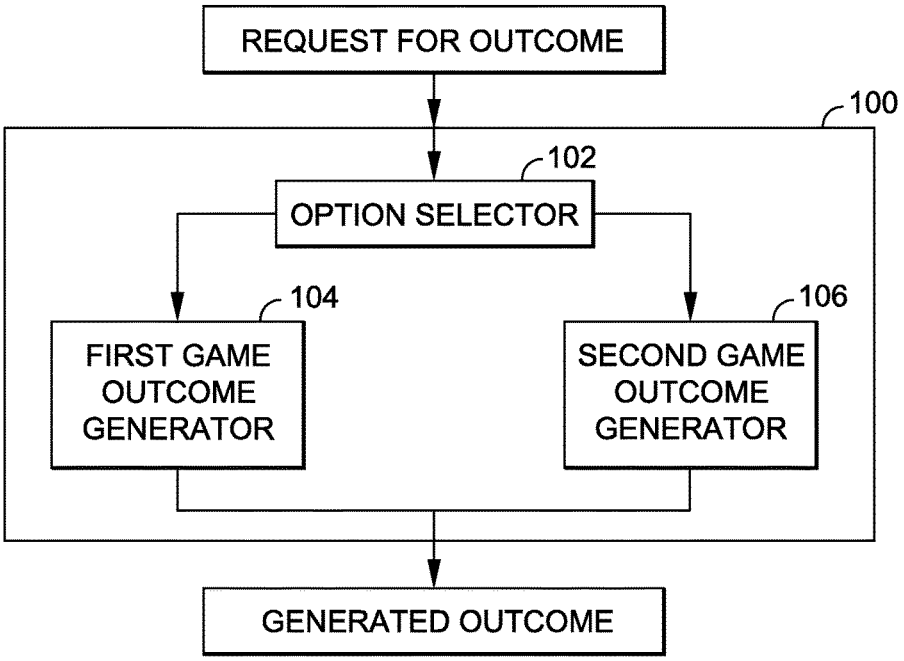
FIG. 2 illustrates a game outcome generation unit in accordance with an embodiment of the present invention.

One embodiment of the invention comprises a game outcome generator or a game outcome generation unit. One embodiment of a game outcome generation unit 100 will be described with reference to FIG. 2. In one embodiment, the game outcome generation unit 100 comprises an option selector 102, a first game outcome generator 104 and a second game outcome generator 106. In one embodiment, these elements may be implemented by software.

As indicated above, the game outcome generation unit 100 might be implemented at the gaming machine or at one or more remote devices, such as a remote game server (wherein the remote game server generates game outcomes and then provides game outcome data to the gaming machine for use in presenting a game). In one embodiment, the game outcome generation unit 100 is implemented as machine readable/executable code or "software" via a controller or processor (such as via the gaming machine controller or remote server controller). The software representing the game outcome generation unit 100 may be stored on a data storage device, such as in a memory which is accessible by the controller or processor, or might comprise a portion of the controller or processor (e.g. be pre-programmed). It will be appreciated that the game outcome generation unit 100 could be a part of a larger group of software, such as software for implementing a particular game, or might be separate therefrom.

Further details of the game outcome generation unit 100 will now be described. In one embodiment, a request for a game outcome is provided to the game outcome generation unit 100. This request might comprise a signal or instruction, such as from the controller of the gaming machine. As one example, a player may provide input to the gaming machine to play a game, such as by pressing a "spin" button. The controller of the gaming machine may receive that signal and begin a game play sequence, including generating a signal or instruction to the game outcome generation unit 100 to generate a game outcome. For example, the instruction might comprise an instruction to execute software comprising the game outcome generation unit 100. In the event the game outcome generation unit 100 is implemented remotely, such as at a game server, the gaming machine controller might send a signal or request to the remote server requesting a game outcome, which signal or request is utilized by the remote server to operate the game outcome generation unit 100.

In response to the request for an outcome, the option selector 102 preferably selects either the selection of a game outcome via the first game outcome generator 104 or the second game outcome generator 106. The option selector 102 may make this selection in various ways, including randomly, in weighted random fashion, or in other manners. In a preferred method, the option selector 102 is configured to implement a weighted selection, wherein the second game outcome generator 106 is selected, on average, less often than the first game outcome generator 104. In one embodiment, the second game outcome generator 106 is preferably selected less than 10% of all selections, and more preferably as little as 1% of all selections, although the particular percentage or weighting may be varied.

If the option selector 102 selects the first game outcome generator 104, then the first game outcome generator 104 is caused to generate a game outcome. If the option selector 102 selects the second game outcome generator 106, then the second game outcome generator is caused to generate a game outcome.

In a preferred embodiment, the game outcome has two components: (1) the game result; and (2) game data representing the result. For example, in the case of a slot-type game, the game result has the components of: (1) a result, such as a losing result or a winning result (and where awards are awarded, any associated award for the result); and (2) the game symbols which define or correspond to that result. In a preferred embodiment, the result may be a losing result having no associated award (e.g. an award of 0 credits and/or a loss of some or all of a player's wager), or it may comprise a winning result, including an award of a number of credits, monies, points or the like. The game data preferably comprises the game symbols which are to be displayed as the game outcome, or data representing those symbols, such as corresponding reel stops/positions or the like.

Figure 3A:
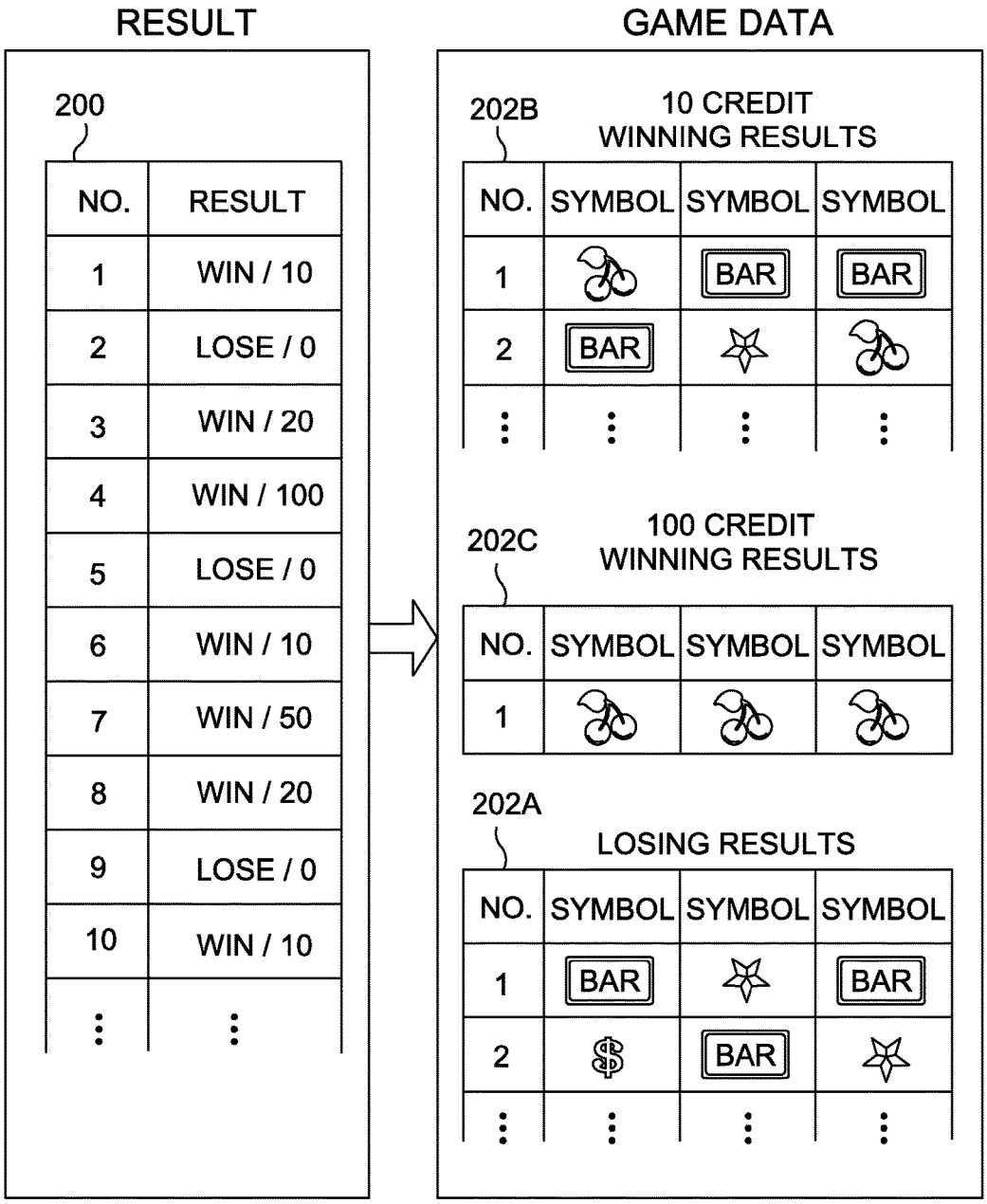
FIG. 3A illustrates a first game outcome generator in accordance with an embodiment of the present invention.

Additional details of the first game outcome generator 104 will be described with reference to FIG. 3A. In general, the first game outcome generator 104 is configured to select a particular result and then generate or select game data which corresponds to that result.

As illustrated therein, in one embodiment, a table of results 200 is provided. The table of results 200 may define a plurality of awards, preferably including awards corresponding to winning and losing outcomes. The table may be weighted, such that certain outcomes are more likely to occur than others. For example, as illustrated, a "losing" result and a wining "10 credit" result are more likely to be selected than a winning "20 credit", "50 credit" or "100 credit" result (due to the frequency of those results in the table). In one embodiment, each result may be associated with a number or position. A random number may be generated and utilized to select the corresponding number or position of the result table or the position/number may be selected in other manners. Because one or more tables are used to select particular results, in this configuration, the first game outcome generator might be referred to as a template or award selector.

Once a result is selected, then corresponding game data is selected or generated. In the case of a slot-type game, this preferably comprises one or more game symbols (or other information corresponding to those symbols, such as reel stops/positions or the like). In a simplified example, if the slot type game is configured with three (3) reels which each display a single symbol, the game data comprise three symbols, one symbol each to be displayed by each reel.

In one embodiment, the game data may be selected from one or more tables. Preferably, game data is provided corresponding to each award or outcome. Thus, a table 202A of game data may be provided relative to a "losing" result. This table 202A may provide different game data, such as different sets of game data that correspond to a losing result. In one embodiment, one of the sets of game data is selected. The game data may comprise, for example, symbols to be displayed by the reels as the outcome of the game (or reel stops/positions corresponding to those symbols). Similarly, other tables 202B,C may be provided relative to other results, such as 10 credit winning result, a 100 credit winning result, etc. Once again, various mechanisms may be used for generating or selecting the game data, such as random or weighted selection from tables or the like.

In a preferred embodiment, the first game outcome generator 104 is not capable of generating all potential game outcomes, such as all possible symbol combinations in the case of a slot-type game. Instead, the game outcomes, either by result or game data corresponding to particular results, represents only a certain subset of all potential outcomes. For example, the first game outcome generator 104 might only be capable of generating 70% of all potential game outcomes, thus limiting the amount of data which must be generated or provided in order to implement the first game outcome generator 104. For example, in this embodiment, the size of the result table and/or the size of the associated game data tables may be substantially reduced as compared to the size(s) of those tables if all possible game outcomes were represented. Additional details of this aspect of the invention are described in more detail below.

As indicated above, the option selector 102 might instead select the second game outcome generator 106 to generate the game outcome. In general, the second game outcome generator 106 is configured to generate or select game data (such as particular symbols or reel stops) and then determine the associated result which corresponds to the generated/selected game data. In the embodiment where the second game outcome generator 106 generates game outcomes by selecting particular symbols comprising the game data, the generator might be referred to as a "symbol selector."

Figure 3B:
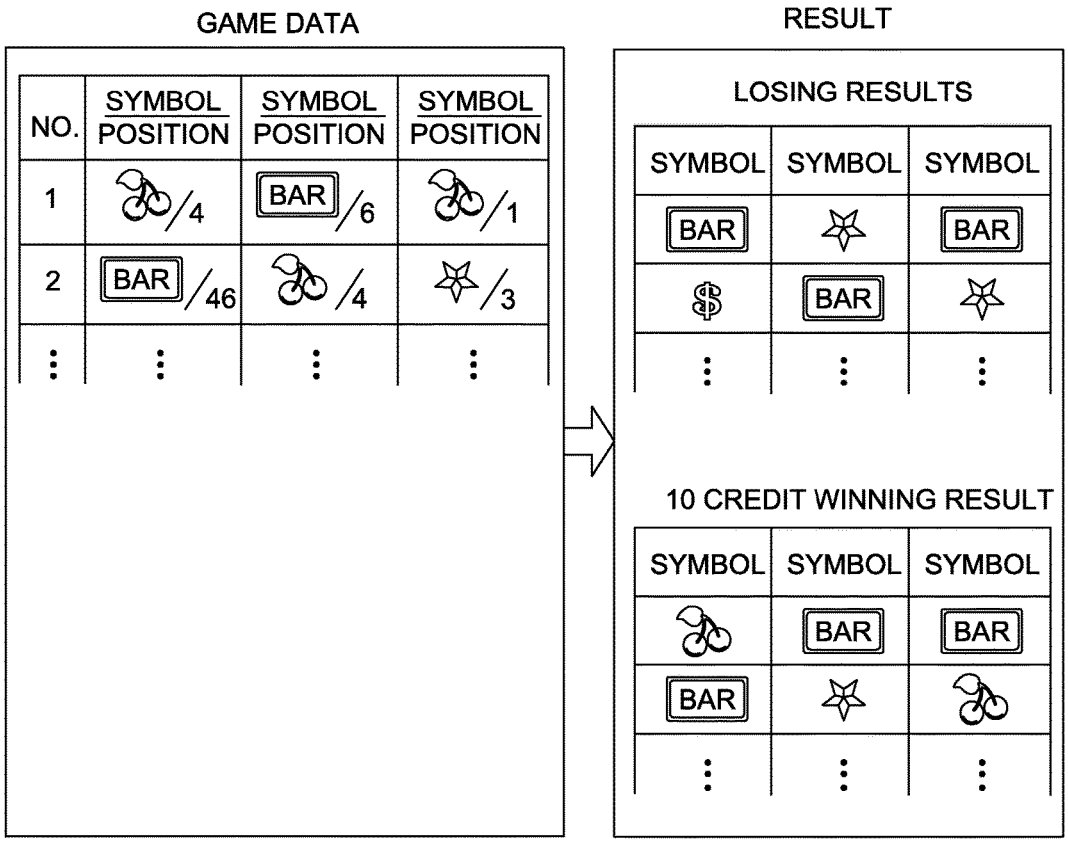
FIG. 3B illustrates a second game outcome generator in accordance with an embodiment of the present invention.

Thus, as illustrated in FIG. 3B, in one embodiment, the second game outcome generator 106 is configured to directly generate or select game data. For example, in the event the game is a slot-type game in which reels may display different symbols, the symbol selector 106 is configured to select symbols (or reel positions corresponding to the symbols). As illustrated, a table 300 of outcomes may define different game data and game data is selected from that table, such as using a selected number/position or the like. In other embodiment, the game data may be generated by selecting individual symbols, reel stops or the like, such as by selecting a particular symbol or reel stop corresponding to a first reel, then by selecting a particular symbol or reel stop corresponding to a second reel, etc., from all possible symbols or stops for each reel.

Once the game data is generated or selected, the corresponding result of the game is determined. In particular, the game data is evaluated to determine whether that data (such as a combination of slot symbols) defines a winning or losing result (and any associated award). For example, the game data may be compared to one or more pay tables to determine whether the game data (such as a set of slot symbols) comprises a winning or losing result. In other embodiment, the result(s) may be built into or linked to the game data table or the game data. In a preferred embodiment, the second game outcome generator 106 is capable of generating all potential game outcomes for the game, such as by being capable of randomly selecting symbols from all symbols used in the play of the game.

Once the first game outcome generator 104 or the second game outcome generator 106 generates a game outcome, that generated outcome may be used to present the game to the player. For example, the generated game outcome, including the game data, may be provided to the gaming machine controller. In the case of a video-implemented game, the gaming machine controller may then cause a graphical representation of the game data to be displayed to the player. This graphical representation would comprise the game data which represents the outcome of the game. For example, in the case of a video slot game, the graphical representation could comprise graphically spinning reels which stop to display the game symbols which correspond to the award/outcome selected by the template selector 104 or which comprise the symbols/positions selected as the game data by the symbol selector 106.

Any award associated with the result is also preferably awarded to the player. For example, if the first game outcome generator 104 selected a losing result, the player might be awarded zero (0) credits and lose their wager. If the first game outcome generator 104 selected a winning 20 credit result, the player would be awarded twenty (20) credits. Likewise, if the second game outcome generator 106 selected game data which corresponded to a losing result, no credits would be awarded. If the second game outcome generator 106 selected game data which corresponded to a winning 20 credit result, 20 credits would be awarded.

Likewise, if the gaming machine includes physical reels which bear symbols, the reels would be stopped to display the generated game outcome. For example, the gaming machine controller may send out motor control instructions which cause the one or more reels to stop at positions or stops which display the symbols which comprise the game outcome.

It will be appreciated that the game data might comprise slot-type symbols or other symbols or elements, such as images of cards or the like. In this regard, aspects of the invention may be applied to games other than slot-type games (including bonus or other types of games).

Additional aspects of the invention will now be described. In accordance with the invention, a game outcome generator is configured to generate game outcomes using at least two different types of generators or selectors (while not described in detail herein, it is possible that more than two different game outcome generators could be utilized). Preferably, one outcome generator is configured to select game results, such as by award, and to then generate or select game data which matches the selected result. This type of selector has the advantage that it allows the "win percentage" or "payback" of the machine, as well as the volatility of the machine (the ratio of winning to losing outcomes) to be modified or controlled. In particular, this manner of selection allows the game designer to use a weighted table or selector which allows control over the frequency of winning to losing results and/or the frequency of different winning results/awards.

In addition, however, in accordance with the invention, the first game outcome generator is configured so that is cannot generate all possible game outcomes. This allows the complexity of the first game outcome generator to be reduced. For example, as indicated above, this allows the size of the template/table(s) to be substantially reduced (as compared to the size of the templates/tables which would be necessary to represent all potential game outcomes). This substantially reduces the amount of data associated with the first game outcome generator, and thus reduces the memory/data storage requirement for the gaming machine (or associated device which implements the game generator), the time necessary to generate the table(s), and also increases the speed at which game outcomes may be generated.

However, most importantly, the game outcome generation unit of the invention is capable of generating all potential game outcomes for the game. This ensures that the game can be presented to a player in a manner which allows every single possible game outcome to be presented during game play. In particular, in accordance with the invention, the game outcome generation unit includes a second game outcome generator which is capable of generating all potential game outcomes. In one embodiment, this generator is capable of selecting game data representing all possible outcome of the game (such as by randomly selecting game symbols or reel positions). This ensures that the player has the opportunity to receive all possible game outcomes.

As one example, the first game outcome generator or "template" generator, might be configured to include all or nearly all potential winning results (such as particular winning awards/values), but only a limited set of the potential game data for those results. This allows the first game outcome generator to generate game outcomes which represent essentially all results (such as losing results or winnings results having different awards), while at the same time greatly reducing the amount of associated game data (e.g. the game data representing the multitude of different combinations of symbols, etc., that could comprise the results).

For example, a five (5) reel game might have reels with 63, 71, 75, 75 and 60 associated symbols/positions and thus have as many as 1.5 billion possible symbol combinations comprising game outcomes. However, the game may only have around 280 different results/awards (losing result of 0 credits, winnings result of 2 credits, winning result of 4 credits, etc.). The first game outcome generator may be configured to select any of the potential 280 results. However, the game data associated with those results may be limited. For example, there may be as many as 1 billion outcomes that comprise a losing result, but the first game outcome generator may only store or be capable of generating a small number of those combinations (such as a few thousand). As one example, if the first game outcome generator was configured with tables or templates representing all 1.5 billion possible outcomes, a data file roughly 7 GB in size would be required. On the other hand, in accordance with the configuration just described, the associated data file might only be 1.1 MB in size (0.0157% of the original size). This reduction is substantial not only from the raw data perspective, but the memory cost and the potential time to access/generate results (for example, if the 7 GB data file had to be located on a hard drive because of its size, the time to access the data would be far greater than if the data was stored in a solid state memory, such as RAM, thus reducing the speed of presentation of the game). At the same time, although the first game outcome generator might only be capable of generating such a small sub-set of game data, the second game outcome generator is capable of generating all of the potential 1.5 billion outcomes, thus ensuring that all game outcomes are/can be presented to the player as a result of game play.

It will be understood that the above described arrangements of apparatus and the method there from are merely illustrative of applications of the principles of this invention and many other embodiments and modifications may be made without departing from the spirit and scope of the invention as defined in the claims.

What is claimed is:

1. A gaming machine having a game outcome generator comprising:

a controller;

at least one game information display device;

at least one player input device;

machine-readable code, fixed in a tangible medium and executable by said controller, configured to:

select either a first game outcome generator or a second game outcome generator;

if said first game outcome generator is selected, generate a game outcome comprising selecting a game result and then selecting game data defining an outcome which corresponds to said result and to output said game outcome;

and if said second game outcome generator is selected, generate a game outcome comprising selecting game data and then determining a result corresponding to that result and to output said game outcome;

and machine-readable code executable by said controller to cause said controller to cause said at least one game outcome display device to present said game outcome generated by said first or second game outcome generator and awarding any award associated with said game outcome.

2. The gaming machine in accordance with claim 1 wherein said at least one display device comprises at least one video display configured to display a game outcome graphically.

3. The gaming machine in accordance with claim 1 wherein said at least one display device comprises at least one physical reel which is capable of being rotated to a stopping position.

4. The gaming machine in accordance with claim 1 wherein said first game outcome generator comprises a template selector configured to select a result from at least one table of results and select game data corresponding to the selected result.

5. The gaming machine in accordance with claim 4 wherein said result may comprise a losing outcome having no associated award of monetary value credits.

6. The gaming machine in accordance with claim 4 wherein said result may comprise a winning outcome having an associated award of monetary value credits.

7. The gaming machine in accordance with claim 1 wherein said first game outcome generator is only capable of generating a portion of all possible outcomes of said game.

8. The gaming machine in accordance with claim 1 wherein said machine-readable code, fixed in a tangible medium and executable by said controller, is configured to select said first game outcome generator more often than said second game outcome generator.

9. A computer program product residing on a non-transitory computer-readable medium and comprising computer-readable instructions configured to cause a processor to:

implement a first game outcome generator configured to generate a game outcome comprising selecting a game result and then select game data defining an outcome which corresponds to said selected result;

implement a second game outcome generator configured to generate a game outcome comprising selecting game data and then determining a game result corresponding to said game data; and implement a selector configured to select either said first game outcome generator or said second game outcome generator;

wherein if said first game outcome generator is selected, said first game outcome generator generates a first game outcome;

and if said second game outcome generator is selected, said second game outcome generator generates a second game outcome.

10. The computer program product in accordance with claim 9 wherein said processor is associated with a gaming machine having a housing, at least one player input device and at least one game display device.

11. The computer program product in accordance with claim 9 wherein said processor is associated with a game server which communicates with a gaming machine comprising a housing, at least one player input device, at least one display device and at least one controller configured to present a game at said gaming machine.

12. The computer program product in accordance with claim 9 wherein said first game outcome generator is only capable of generating a portion of all possible outcomes of a game.

13. The computer program product in accordance with claim 9 wherein said selector is configured to select said first game outcome generator more often than said second game outcome generator.

14. The computer program product in accordance with claim 9 wherein said first game outcome generator comprises at least one table of results from which a result is selected.

15. The computer program product in accordance with claim 9 wherein said game data selected by said second game outcome generator comprises one or more game symbols.

16. The computer program product in accordance with claim 9 wherein said game data selected by said second game outcome generator comprises one or more reel stopping positions.

* * * * *